US008985431B2

(12) United States Patent
Smith et al.

(10) Patent No.: US 8,985,431 B2
(45) Date of Patent: Mar. 24, 2015

(54) POLYGONAL CONTAINER HAVING REINFORCED CORNER STRUCTURES AND BLANK FOR FORMING SAME

(71) Applicant: Rock-Tenn Shared Services, LLC, Norcross, GA (US)

(72) Inventors: Kenneth Charles Smith, Hiram, GA (US); Jeffrey Scott James, Elmhurst, IL (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 58 days.

(21) Appl. No.: 13/713,830

(22) Filed: Dec. 13, 2012

(65) Prior Publication Data

US 2013/0153648 A1 Jun. 20, 2013

Related U.S. Application Data

(60) Provisional application No. 61/570,689, filed on Dec. 14, 2011.

(51) Int. Cl.

| | |
|---|---|
| ***B65D 5/28*** | (2006.01) |
| ***B65D 21/032*** | (2006.01) |
| ***B65D 5/42*** | (2006.01) |
| ***B31B 7/00*** | (2006.01) |
| ***B65D 5/00*** | (2006.01) |
| ***B65D 5/44*** | (2006.01) |

(52) U.S. Cl.

CPC ... *B65D 5/42* (2013.01); *B31B 7/00* (2013.01); *B65D 5/003* (2013.01); *B65D 5/443* (2013.01); *Y10S 229/918* (2013.01)

USPC ..... 229/109; 229/170; 229/174; 229/918

(58) Field of Classification Search

USPC ..... 229/109, 170, 171, 174, 191, 915, 918, 229/919

See application file for complete search history.

(56) References Cited

U.S. PATENT DOCUMENTS

| | | | | |
|---|---|---|---|---|
| 3,474,901 | A * | 10/1969 | Viater | 229/174 |
| 4,056,223 | A | 11/1977 | Williams | |
| 4,417,686 | A | 11/1983 | Wozniacki | |
| 4,537,344 | A * | 8/1985 | Thomas | 229/915 |
| 4,676,429 | A | 6/1987 | Crowe et al. | |
| 4,792,084 | A | 12/1988 | Dreeszen | |
| 4,911,355 | A * | 3/1990 | Bannister | 229/178 |
| 5,028,000 | A * | 7/1991 | Chabot et al. | 229/191 |
| 5,163,609 | A * | 11/1992 | Muise, Jr. | 229/174 |
| 5,285,956 | A | 2/1994 | Piepho | |
| 5,295,623 | A * | 3/1994 | Bacques et al. | 229/109 |
| 5,535,941 | A | 7/1996 | Garza | |

(Continued)

OTHER PUBLICATIONS

PCT Search Report with Written Opinion dated Feb. 8, 2013 for App. No. PCT/US2012/069558 (8 Pages).

*Primary Examiner* — Gary Elkins

(74) *Attorney, Agent, or Firm* — Armstrong Teasdale LLP

(57) ABSTRACT

A blank for forming a reinforced container is provided. The blank includes a bottom panel comprising opposing end edges, opposing side edges, and at least one miter edge connecting one of the end edges to an adjacent side edge of the opposing side edges. The blank further includes a pair of opposing end panels coupled to the bottom panel, a pair of opposing side panels coupled to the bottom panel, and a reinforcing panel assembly coupled to at least one of one of the end panels and one of the side panels for reinforcing a corner of the container.

20 Claims, 18 Drawing Sheets

(56) References Cited

U.S. PATENT DOCUMENTS

| | | | | |
|---|---|---|---|---|
| 5,752,648 | A | 5/1998 | Quaintance | |
| 6,220,508 | B1 | 4/2001 | Wisser | |
| 6,481,619 | B1 | 11/2002 | Jackson | |
| 6,588,651 | B2 | 7/2003 | Quaintance | |
| 6,935,504 | B2 * | 8/2005 | Ritter et al. | 206/511 |
| 7,090,115 | B2 | 8/2006 | Pierce | |
| 7,290,696 | B2 | 11/2007 | McClure | |
| 7,549,570 | B2 | 6/2009 | Quaintance | |
| 7,717,320 | B2 | 5/2010 | Quaintance | |
| 7,806,313 | B2 | 10/2010 | Philips | |
| 7,959,063 | B2 | 6/2011 | McLeod | |
| 8,087,569 | B2 | 1/2012 | Ledvina | |
| 8,091,770 | B2 | 1/2012 | McLeod | |
| 8,105,223 | B2 | 1/2012 | Graham et al. | |
| 8,205,787 | B2 | 6/2012 | Panduro et al. | |
| 8,251,276 | B2 | 8/2012 | McLeod | |
| 8,272,560 | B2 * | 9/2012 | Quaintance | 229/109 |
| 2009/0145955 | A1 | 6/2009 | McLeod | |
| 2009/0272789 | A1 | 11/2009 | Fry | |
| 2009/0277952 | A1 | 11/2009 | Smith | |
| 2009/0280973 | A1 * | 11/2009 | Graham et al. | 493/127 |
| 2010/0065621 | A1 * | 3/2010 | Quaintance | 229/191 |
| 2010/0219232 | A1 | 9/2010 | Smith | |
| 2011/0056937 | A1 | 3/2011 | Smith et al. | |
| 2011/0281705 | A1 | 11/2011 | Aganovic et al. | |
| 2012/0000973 | A1 | 1/2012 | McLeod | |
| 2012/0100977 | A1 | 4/2012 | Graham et al. | |

* cited by examiner

POLYGONAL CONTAINER HAVING REINFORCED CORNER STRUCTURES AND BLANK FOR FORMING SAME

CROSS REFERENCE TO RELATED APPLICATIONS

This application claims priority to U.S. Provisional Application No. 61/570,689 filed Dec. 14, 2011 which is hereby incorporated by reference in its entirety.

BACKGROUND OF THE DISCLOSURE

The field of the invention relates generally to a blank of sheet material and a polygonal container formed from the blank, and more particularly to a blank of sheet material for forming a polygonal container having reinforced corner structures for transporting a product stored within the container.

Containers are frequently utilized to store and aid in transporting products. The shape of the container can provide additional strength to the container. For example, octagonal-shaped containers provide greater resistance to bulge over conventional rectangular, square or even hexagonal-shaped containers.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport, and/or storage and/or display without collapsing. It is desirable to provide a container that meets these strength requirements.

Further, it is a known practice to employ containers to transfer products to the place of sale, such as a retail store. One drawback of such containers is that a significant amount of labor is required to remove the products from the container and, in turn, place the products on display shelves. Accordingly, it is desirable to provide a container that is convertible to a display container that prevents the products from falling out of the display container and that permits customers to see the products.

BRIEF DESCRIPTION OF THE DISCLOSURE

In one aspect, a blank for forming a reinforced container is provided. The blank includes a bottom panel having opposing end edges, opposing side edges, and at least one miter edge connecting one of the end edges to an adjacent side edge of the opposing side edges. The blank further includes a pair of opposing end panels coupled to the bottom panel, a pair of opposing side panels coupled to the bottom panel, and a reinforcing panel assembly coupled to at least one of one of the end panels and one of the side panels for reinforcing a corner of the container.

In another aspect, a reinforced container formed from a blank of sheet material is provided. The container includes a bottom wall comprising at least one miter edge connecting adjacent edges of the bottom wall. The container further includes a pair of opposing end walls coupled to the bottom wall, a pair of opposing side walls coupled to the bottom wall, and a reinforcing corner assembly coupled to at least one of one of the end walls and one of the side walls for reinforcing a corner of the container.

In yet another aspect, a method of forming a reinforcing container from a blank, wherein the blank includes a bottom panel, a pair of opposing end panels coupled to the bottom panel, a pair of opposing side panels coupled to the bottom panel, a pair of opposing top panels coupled to the pair of opposing side panels, and a reinforcing assembly coupled to one of the end panels and one of the top panels. The method includes rotating the pair of end panels toward the bottom panel to form a pair of opposing end walls, and rotating the pair of side panels toward the bottom panel to form a pair of opposing side walls. The method further includes rotating the top panels toward the side walls and the bottom panel to form a pair of opposing top walls, and rotating the reinforcing assembly to form a reinforcing corner assembly.

DETAILED DESCRIPTION OF THE DISCLOSURE

Figure 1:
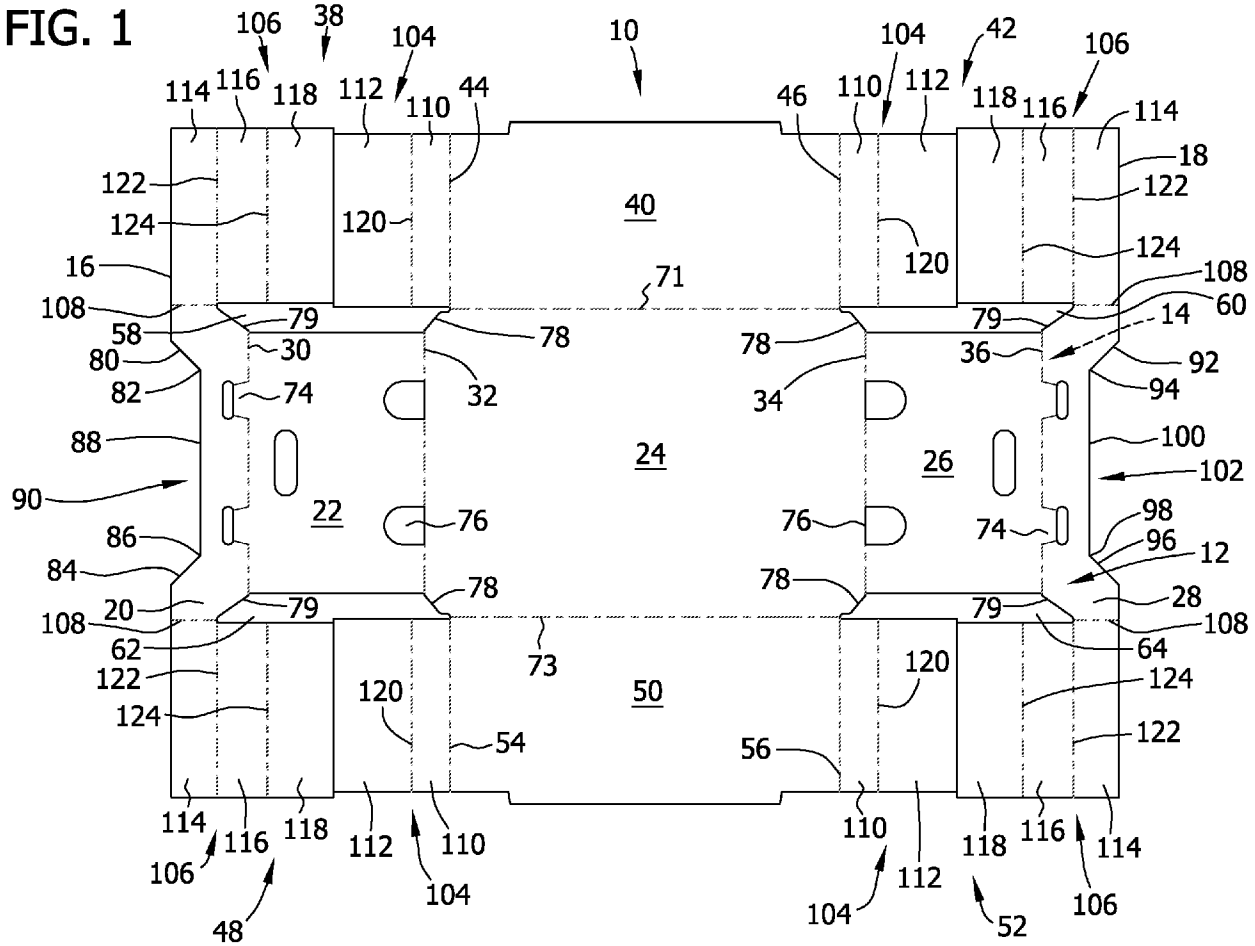
FIG. 1 is a top plan schematic illustration of a blank of sheet material of an example embodiment of the present invention.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, reinforced container formed from a single sheet of material, and a method for constructing the container. The container is sometimes referred to as a reinforced mitered tray or a reinforced eight-sided tray. The container may be constructed from a blank of sheet material using a machine and/or by hand. For example, the blank can be wrapped about a mandrel to form the container or formed using a tray former machine. Alternatively, a folder/glue machine can be used to convey the blank through folder arms and an adhesive applicator to form a knocked-down flat container which can then be fully formed by hand. In another embodiment, the container can be formed by a machine as a wraparound container wherein the container is wrapped around a load of products contained within the container. In one embodiment, the container is fabricated from a paperboard material. The container, however, may be fabricated using any suitable material, and therefore is not limited to a specific type of material. In alternative embodiments, the container is fabricated using cardboard, fiberboard, paperboard, foamboard, corrugated paper, and/or any suitable material known to those skilled in the art and guided by the teachings herein provided. The container may include lines of perforation for removal of a portion of the container for displaying articles for sale, and a blank used for forming the container is described below in detail.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

It should be understood that features included in one embodiment can be used with other embodiments described herein. Further, any of the containers described herein can include handles defined through end and/or side walls thereof. Moreover, vent holes, can be defined through any suitable panel in any of the embodiments and have any suitable size, shape, orientation, and/or location that enable the below-described blanks and containers to function as described herein. Still further, the containers described herein can include adhesives such as, but not limited to, glue, tape and sealing strips which can have any suitable size, shape, orientation, and/or location that enable the below-described blanks and containers to function as described herein.

Different embodiments described here can vary in size and/or dimensions although similar labels are used for each embodiment. For example, although a depth is labeled similarly throughout the description, each embodiment can have varying depths.

Figure 2:
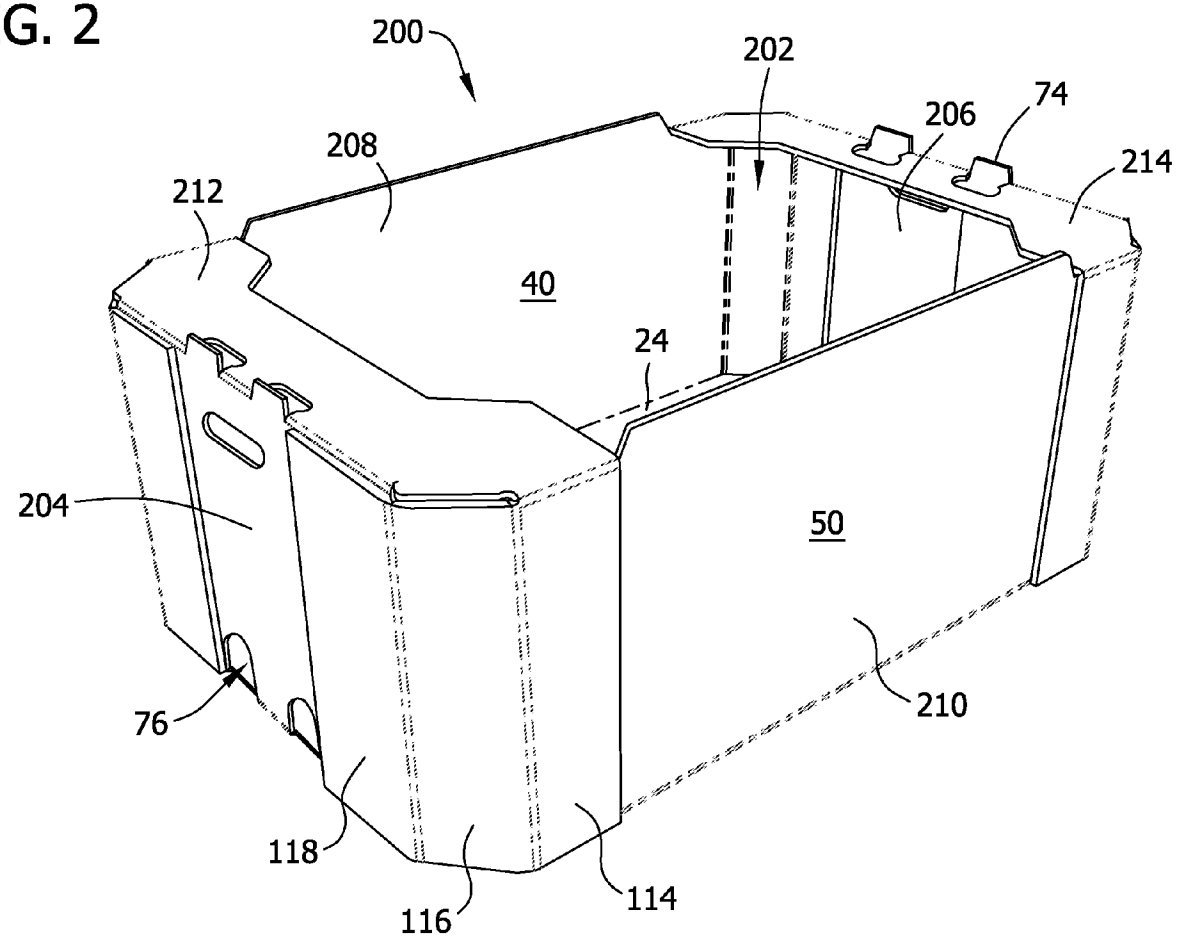
FIG. 2 is a perspective schematic illustration of a container formed from the blank shown in FIG. 1.

Referring now to the drawings, and more specifically to FIGS. 1 and 2, although as described above a container may have any suitable size, shape, and/or configuration, FIGS. 1 and 2 illustrate the construction or formation of one example embodiment of the container. Specifically, FIG. 1 is a top plan view of an example blank 10 of sheet material. FIG. 2 is a top perspective view of a container 200 formed from blank 10.

Referring to FIGS. 1 and 2, blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first top panel 20, a first side panel 22, a bottom panel 24, a second side panel 26, and a second top panel 28 coupled together along preformed, generally parallel, fold lines 30, 32, 34, and 36, respectively. Blank 10 includes, in series from leading edge 16 to trailing edge 18, a first reinforcing assembly 38, a front end panel 40 and a second reinforcing assembly 42 coupled together along preformed, generally parallel fold lines 44 and 46 respectively. Moreover, blank 10 includes, in series from leading edge 16 to trailing edge 18, a third reinforcing assembly 48, a rear end panel 50 and a fourth reinforcing assembly 52 coupled together along preformed, generally parallel fold lines 54 and 56 respectively. Still further, in the example embodiment, blank 10 defines a first cutout 58, a second cutout 60, a third cutout 62 and a fourth cutout 64.

More specifically, first top panel 20 extends from leading edge 16 to fold line 30, first side panel 22 extends from first top panel 20 along fold line 30, bottom panel 24 extends from first side panel 22 along fold line 32, second side panel 26 extends from bottom panel 24 along fold line 34, and second top panel 28 extends from second side panel 26 along fold line 36 to trailing edge 18. Fold lines 30, 32, 34 and/or 36, as well as other fold lines and/or hinge lines described herein, may include any suitable line of weakening and/or line of separation known to those skilled in the art and guided by the teachings herein provided. When container 200 is formed from blank 10, fold line 32 defines a bottom edge of first side panel 22 and a first side edge of bottom panel 24, and fold line 34 defines a second side edge of bottom panel 24 and a bottom edge of second side panel 26. Further, when container 200 is formed from blank 10, fold line 30 defines a side edge of first top panel 20 and a top edge of first side panel 22, and fold line 36 defines a top edge of second side panel 26 and a side edge of second top panel 28.

Front end panel 40 extends from bottom panel 24 along fold line 71 and rear end panel 50 extends from bottom panel 24 along fold line 73. In the example embodiment, stacking tabs 74 are coupled to first side panel 22 and second side panel 26. Further, in the example embodiment, vent openings 76 are defined along fold lines 32 and 34; however, it should be understood that blank 10 includes any suitable number of vent openings 76 and stacking tabs 74. Further, vent openings 76 and stacking tabs 74 can have any suitable size and/or shape that enables blank 10 and/or container 200 to function as described herein.

In the example embodiment, bottom panel 24 may be considered to be substantially rectangular in shape with four cut-off corners or angled edges 78 formed by cut lines. As such, the cut-off corner edges 78 of otherwise rectangular bottom panel 24 define an octagonal shape of bottom panel 24. Alternatively, bottom panel 24 has any suitable shape that enables container 200 to function as described herein. In an alternative embodiment (not shown), bottom panel 24 may be in the shape of a rectangle having corners that are truncated by a segmented edge such that bottom panel 24 has more than eight sides. In another example (not shown), bottom panel 24 may be in the shape of a rectangle having corners that are truncated by an arcuate edge such that bottom panel 24 has four substantially straight sides and four arcuate sides. In an alternative embodiment (not shown), each angled edge 78 may include a crushed area that facilitates forming container 200 from blank 10.

First top panel 20 and second top panel 28 are substantially congruent and have a generally trapezoidal shape. More specifically, first top panel 20 includes miter edges 79, an angled edge 80 extending from leading edge 16 toward an apex 82, and an angled edge 84 extending from leading edge 16 toward an apex 86. A free edge 88 extends between angled edge 80 and angled edge 84. Angled edge 80, free edge 88 and angled edge 84 define a cutout 90. Second top panel 28 includes an angled edge 92 extending from trailing edge 18 toward an apex 94 and an angled edge 96 extending from trailing edge 18 toward an apex 98. A free edge 100 extends between angled edge 92 and angled edge 96. Angled edge 92, free edge 100 and angled edge 96 define a cutout 102.

First reinforcing assembly 38 and second reinforcing assembly 42 extend from side edges of front end panel 40 and from first top panel 20 and second top panel 28, respectively. Third reinforcing assembly 48 and fourth reinforcing assembly 52 extend from side edges of rear end panel 50 and from first top panel 20 and second top panel 28, respectively. Each side edge is defined by respective fold lines 44, 46, 54 or 56. Fold lines 44, 46, 54 and 56 are substantially parallel to each other. Alternatively, fold lines 44, 46, 54 and/or 56 are other than substantially parallel. Further, each reinforcing panel assembly 38, 42, 48 and 52 are substantially similar and include an inner reinforcing panel assembly 104 and an outer reinforcing panel assembly 106. Moreover, inner reinforcing panel assembly 104 includes a corner panel 110 and a minor panel 112; and outer reinforcing panel assembly 106 includes a first overlap panel 114, a miter panel 116 and a second overlap panel 118. Each reinforcing panel assembly 38, 42, 48 and 52 is configured to form a reinforcing corner assembly 202 (shown in FIG. 2) when container 200 is formed from blank 10.

Inner reinforcing panel assembly 104 extends from front end panel 40 or rear end panel 50 along each of fold lines 44, 46, 54 and 56. Further, outer reinforcing panel assembly 106 extends from first top panel 20 or second top panel 28 along fold lines 108. In the example embodiment, each inner reinforcing panel assembly 104 includes a fold line 120 that divides each inner reinforcing panel assembly 104 into corner panel 110 and minor panel 112. Fold line 120 defines an edge of corner panel 110 and a side edge of minor panel 112. In the example embodiment, corner panel 110 and minor panel 112 are substantially rectangular. Alternatively, corner panel 110 and minor panel 112 are shaped other than substantially rectangular.

Further, each outer reinforcing panel assembly 106 includes fold lines 122 and 124 that divide each outer reinforcing panel assembly 106 into first overlap panel 114, miter panel 116 and second overlap panel 118. More specifically, miter panel 116 extends from first overlap panel 114 along fold line 122, and second overlap panel 118 extends from miter panel 116 along fold line 124. Fold line 122 defines an edge of miter panel 116 and a side edge of first overlap panel 114, fold line 124 defines a side edge of miter panel 116 and an edge of second overlap panel 118. In the example embodiment, corner panel 110 and miter panel 116 are substantially congruent.

Referring to FIG. 2, to construct container 200 from blank 10, first side panel 22 is rotated about fold line 32 toward interior surface 12 of bottom panel 24, front end panel 40 is rotated about fold line 71 toward interior surface 12 of bottom panel 24, second side panel 26 is rotated about fold line 34 toward interior surface 12 of bottom panel 24 and rear end panel 50 is rotated about fold line 73 toward interior surface 12 of bottom panel 24. In the example embodiment, after rotating panels 22, 26, 40 and 50 about fold lines 32, 34, 71 and 73, side panels 22 and 26 are substantially parallel to each other and substantially perpendicular to end panels 40 and 50. Panels 22, 26, 40 and 50 can be rotated about fold lines 32, 34, 71 and 73 by wrapping blank 10 about a mandrel within a machine or by using a tray folder machine.

Once panels 22, 26, 40 and 50 are rotated about fold lines 32, 34, 71 and 73, first side panel 22 forms a first side wall 204, second side panel 26 forms a second side wall 206, front end panel 40 forms a front wall 208 and rear end panel 50 forms a rear wall 210. Once panels 20 and 28 are rotated about fold lines 30 and 36, first top panel 20 forms a first top wall 212 and second top panel 28 forms a second top wall 214. To continue construction, first reinforcing assembly 38 is rotated and coupled to first side panel 22 and front end panel 40 and second reinforcing assembly 42 is rotated and coupled to second side panel 26 and front end panel 40. Third reinforcing assembly 48 is rotated and coupled to first side panel 22 and rear end panel 50 and fourth reinforcing assembly 52 is rotated and coupled to second side panel 26 and rear end panel 50.

More specifically, inner assembly 104 of first reinforcing assembly 38 is rotated and coupled to interior surface of first side panel 22, first top panel 20 is rotated about fold line 30 toward interior surface 12 of bottom panel 24, and outer assembly 106 of first reinforcing assembly 38 is rotated and coupled to exterior surfaces 14 of first side panel 22 and front end panel 40.

Inner assembly 104 of second reinforcing assembly 42 is rotated and coupled to interior surface of second side panel 26, second top panel 28 is rotated about fold line 36 toward interior surface 12 of bottom panel 24, and outer assembly 106 of second reinforcing assembly 42 is rotated and coupled to exterior surfaces 14 of second side panel 26 and front end panel 40. Inner assembly 104 of third reinforcing assembly 48 is rotated and coupled to interior surface of first side panel 22, first top panel 20 is rotated about fold line 30 toward interior surface 12 of bottom panel 24, and outer assembly 106 of third reinforcing assembly 48 is rotated and coupled to exterior surfaces 14 of first side panel 22 and rear end panel 50. Inner assembly 104 of fourth reinforcing assembly 52 is rotated and coupled to interior surface of second side panel 26, second top panel 28 is rotated about fold line 36 toward interior surface 12 of bottom panel 24, and outer assembly 106 of fourth reinforcing assembly 52 is rotated and coupled to exterior surfaces 14 of second side panel 26 and rear end panel 50.

In the example embodiment, minor panels 112 are adhered to interior surface 12 of first and second side panels 22 and 26 so that corner panels 110 extend diagonally across the corners of the interior of container 200, acting as stacking support structures. In particular, corner panels 110 are folded over to positions perpendicular to bottom panel 24. Then, first overlap panels 114 are folded down to positions parallel to exterior surfaces 14 of panels 40 and 50. Second overlap panels 118 are then folded perpendicular to first overlap panels 114 and coupled to exterior surfaces 14 of side panels 22 and 26. Miter panels 116 of each assembly 38, 42, 48 and 52 are coupled to angled edges 78 of bottom panel 24 and/or corner panels 110 to form reinforcing corner assemblies 202.

Figure 3:
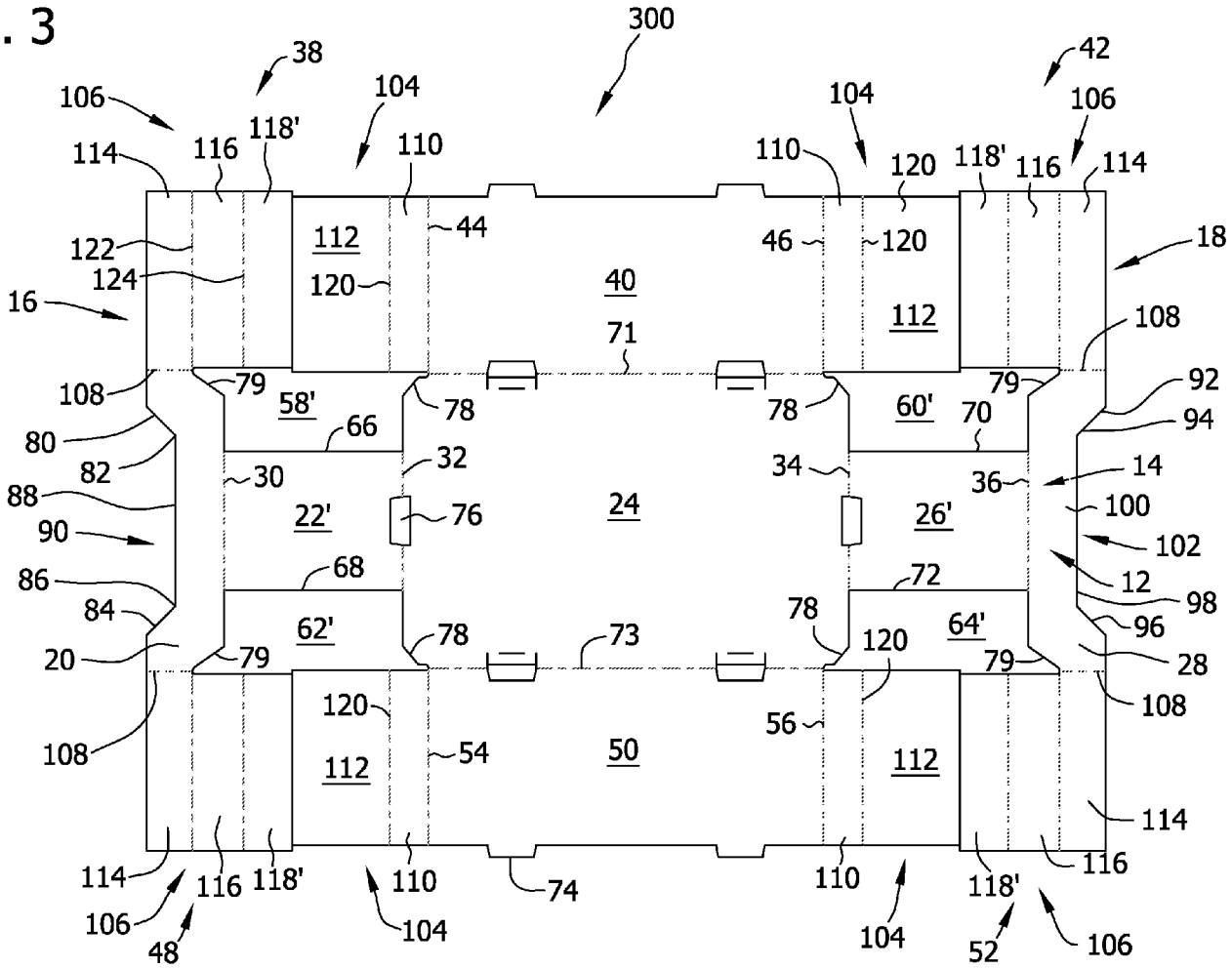
FIG. 3 is a top plan schematic illustration of a blank of sheet material of a first alternate embodiment of the present invention.
Figure 4:
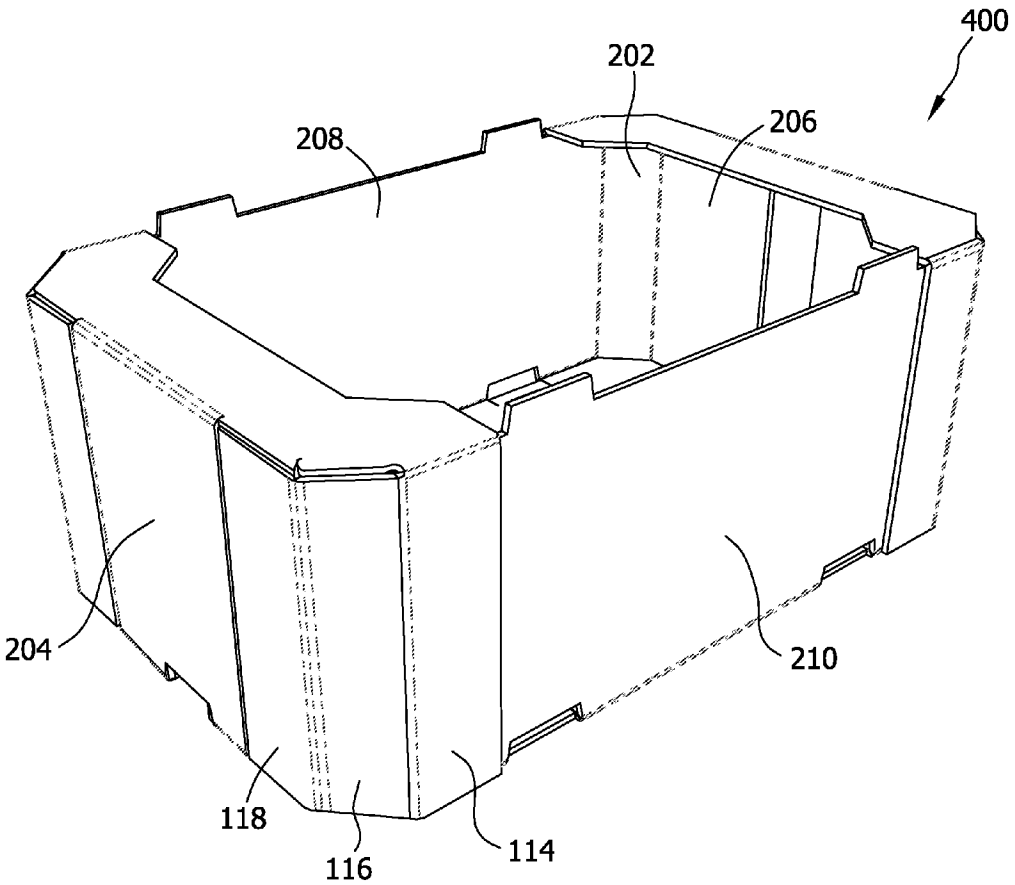
FIG. 4 is a perspective schematic illustration of a container formed from the blank shown in FIG. 3.

FIG. 3 is a top plan view of a first alternative blank 300 of sheet material for forming an alternate embodiment of the container described herein. FIG. 4 is a top perspective view of a container 400 formed from blank 300. Unless otherwise described, blank 300 includes components that are similar to the components described above with reference to blank 10 (shown in FIG. 1), and container 400 includes components that are similar to the components described above with reference to container 200 (shown in FIG. 2). As such, components shown in FIGS. 1 and 2 are labeled with similar reference numbers in FIGS. 3 and 4.

Blank 300 includes first top panel 20, first side panel 22', bottom panel 24, second side panel 26', and second top panel 28 coupled together along fold lines 30, 32, 34, and 36, respectively. Blank 300 also includes front end panel 40 and rear end panel 50 coupled to bottom panel 24 along fold lines 71 and 73 respectively. Moreover, blank 300 includes reinforcing assemblies 38, 42, 48 and 52. In the first alternative embodiment, first side panel 22' and second side panel 26' have different sizes than first side panel 22 and second side panel 26 of FIGS. 1 and 2. Accordingly, cutouts 58', 60', 62' and 64' have different sizes than cutouts 58, 60, 62 and 64 of FIGS. 1 and 2. First side panel 22' also has free edges 66 and 68, and second side panel 26' has free edges 70 and 72. Further, blank 300 includes second overlap panel 118' that has a different size than second overlap panel 118 of FIGS. 1 and 2. Blank 300 also includes minor panel 112 that is slightly wider than minor panel 112 of FIGS. 1 and 2 so that minor panel 112 can attach to side panels 22' or 26', and attach to second overlap panels 118'.

As shown in FIG. 4, cutouts 58', 60', 62' and 64' enable interior surface 12 of second overlap panels 118' to directly contact exterior surface 14 of minor panels 112 and to be oriented substantially coplanar to first side panel 22' or second side panel 26'. In other words, when container 400 is formed, each second overlap panels 118' is positioned within a respective one of cutouts 58', 60', 62', and 64', and is placed in an overlapping relationship with a respective one of minor panel 112 such that a free edge of second overlap panel 118' is positioned adjacent to one of free edges 66, 68, 70, and 72 of first side panel 22' and second side panel 26'.

Figure 5:
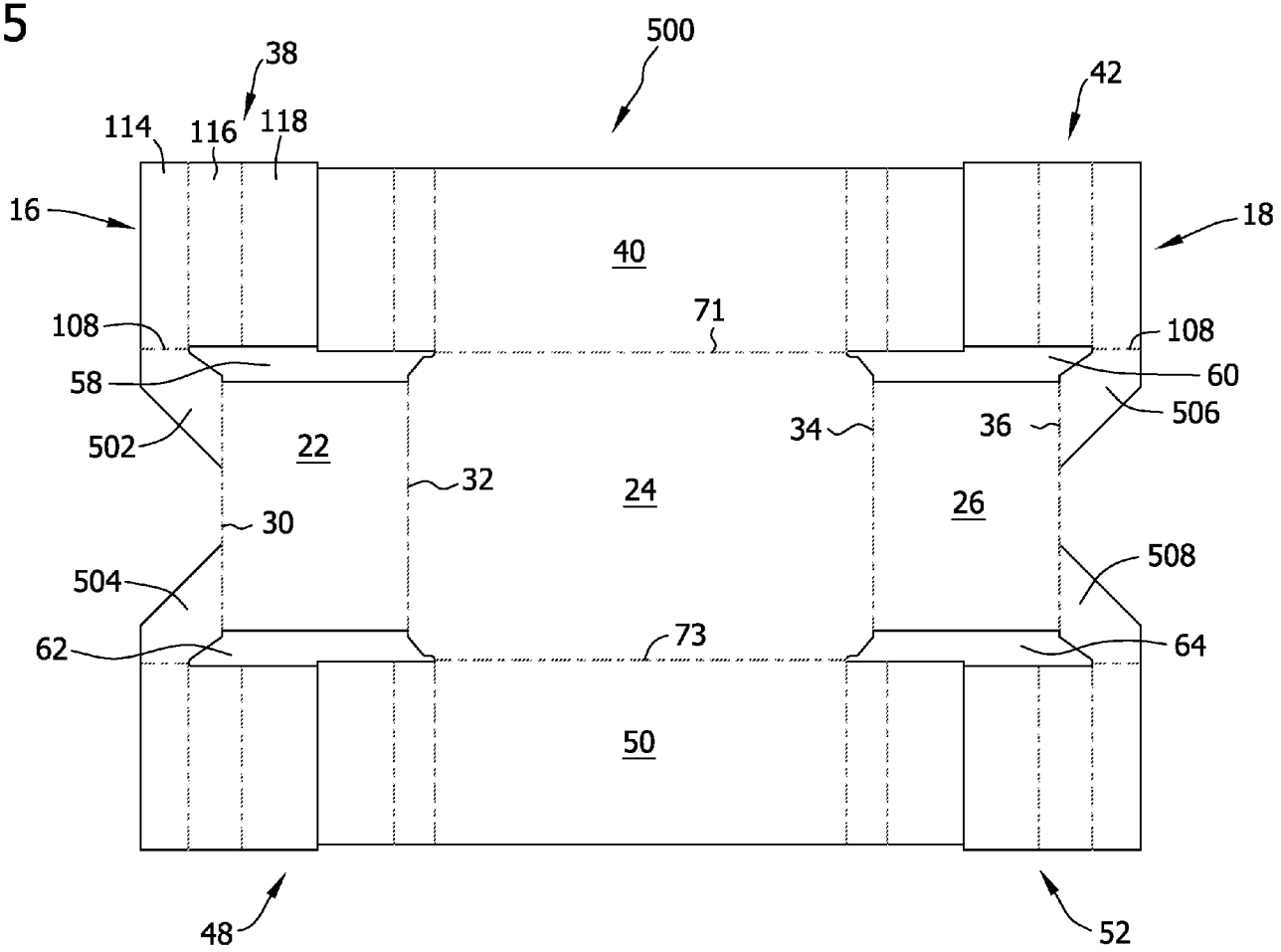
FIG. 5 is a top plan schematic illustration of a blank of sheet material of a second alternate embodiment of the present invention.
Figure 6:
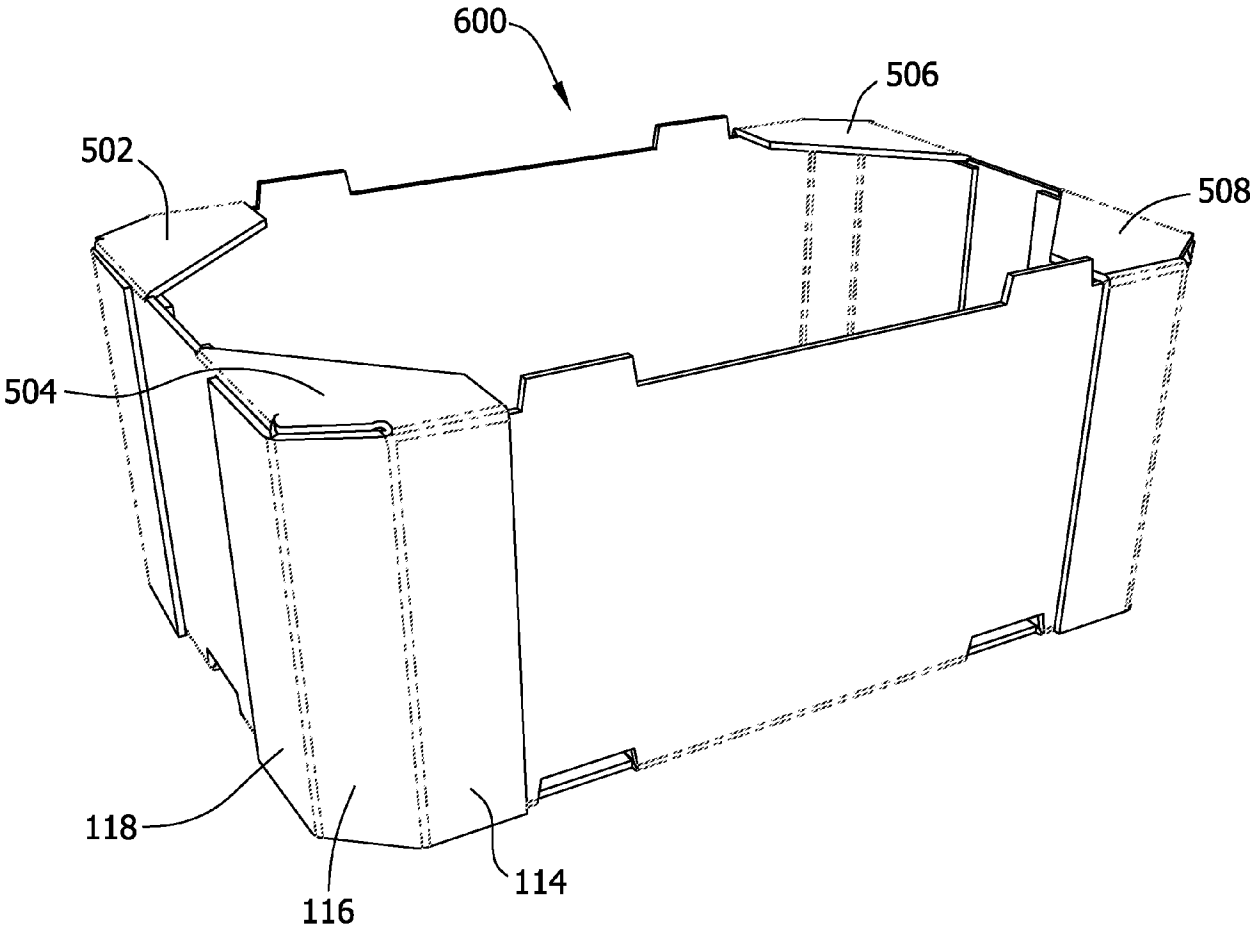
FIG. 6 is a perspective schematic illustration of a container formed from the blank shown in FIG. 5.

FIG. 5 is a top plan view of a blank of a second alternative blank 500 of sheet material for forming an alternate embodiment of the container described herein. FIG. 6 is a perspective schematic illustration of a container 600 formed from the blank 500 shown in FIG. 5. Unless otherwise described, blank 500 includes components that are similar to the components described above with reference to blank 10 (shown in FIG. 1) and blank 300 (shown in FIG. 3), and container 600 includes components that are similar to the components described above with reference to container 200 (shown in FIG. 2) and container 400 (shown in FIG. 4). As such, components shown in FIGS. 1-4 are labeled with similar reference numbers in FIGS. 5 and 6.

Blank 500 includes first side panel 22, bottom panel 24 and second side panel 26 coupled together along fold lines 32 and 34. Blank 500 also includes front end panel 40 and rear end panel 50 coupled to bottom panel 24 along fold lines 71 and 73 respectively. Moreover, blank 500 includes reinforcing assemblies 38, 42, 48 and 52. In the second alternative embodiment, blank 500 includes top corner panels 502, 504, 506 and 508. Top corner panels 502 and 504 extend from leading edge 16 to fold line 30 to couple to first side panel 22. Top corner panels 506 and 508 extend from trailing edge 18 to fold line 36 to couple to second side panel 26. Top corner panels 502, 504, 506 and 508 extend to fold line 108 to couple to first overlap panel 114.

Figure 7:
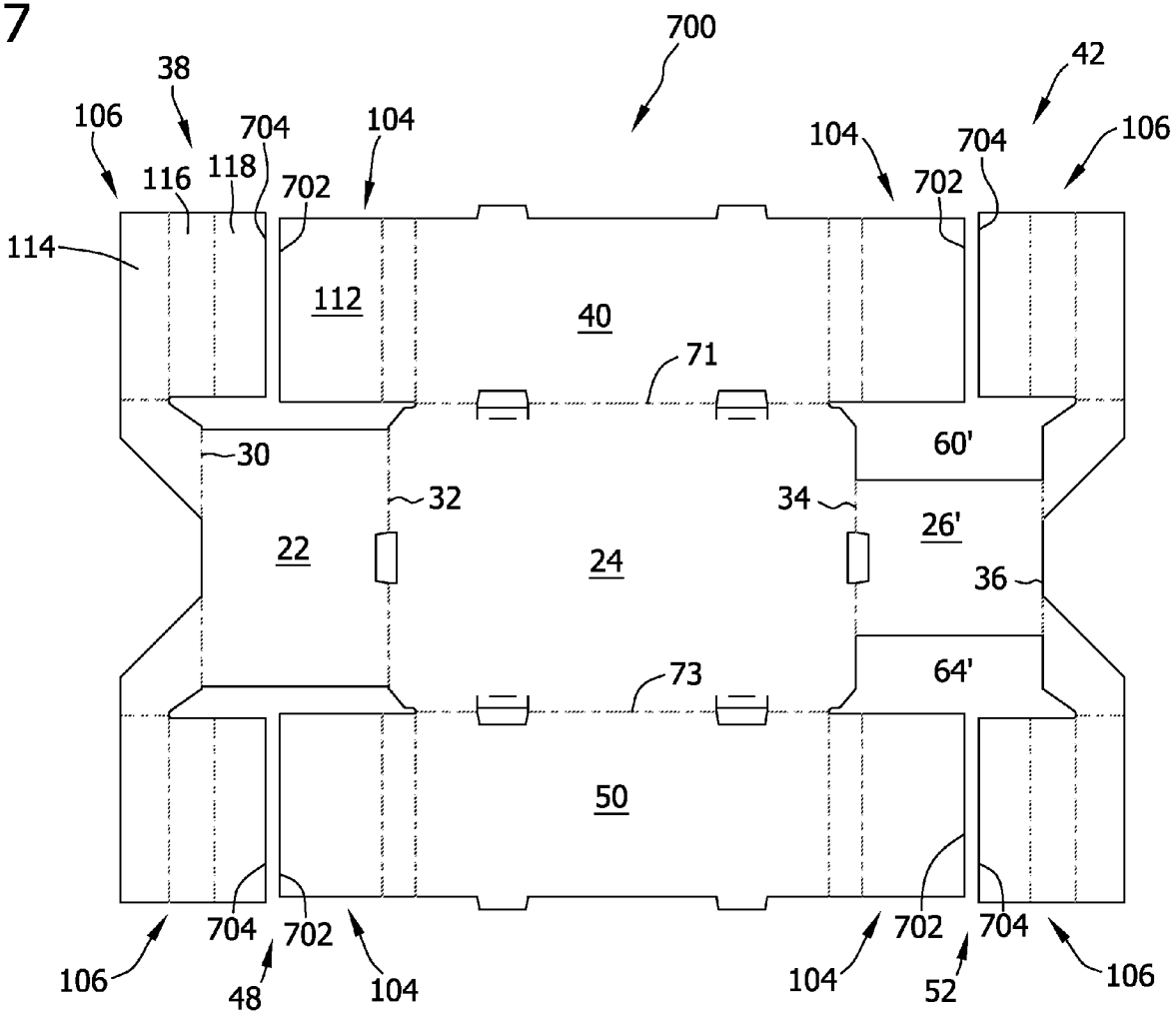
FIG. 7 is a top plan schematic illustration of a blank of sheet material of a third alternate embodiment of the present invention.
Figure 8:
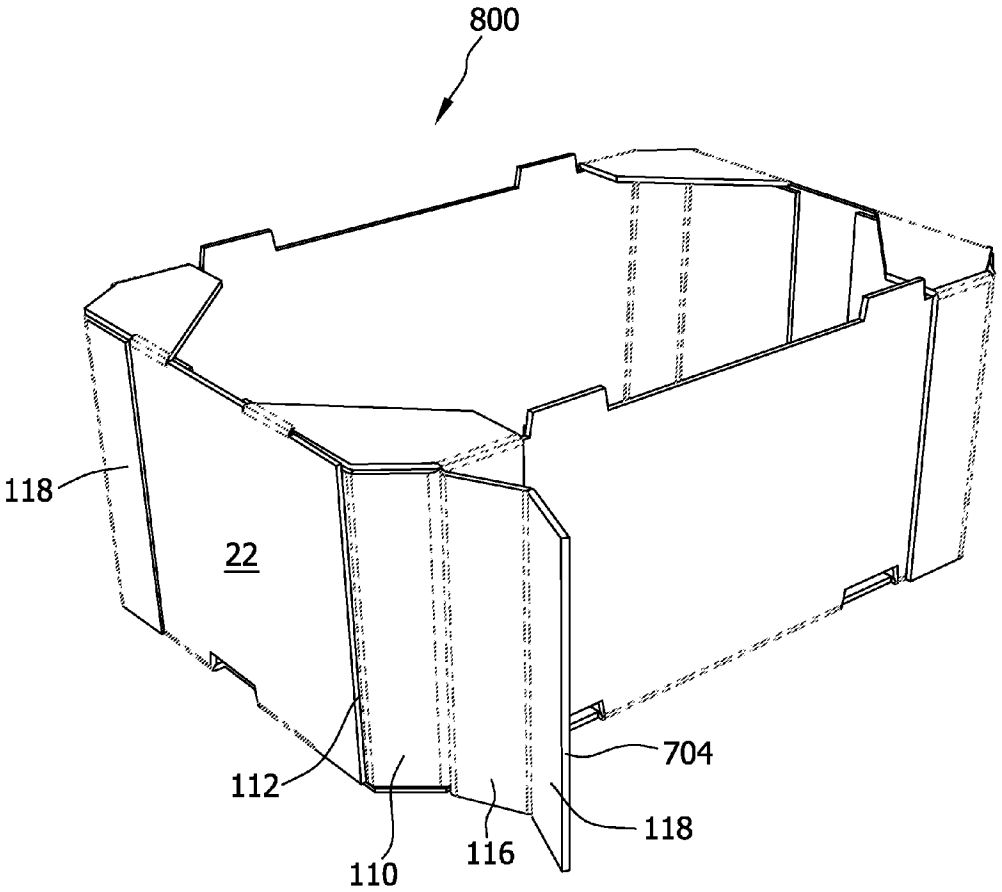
FIG. 8 is a perspective schematic illustration of a container formed from the blank shown in FIG. 7.

FIG. 7 is a top plan view of a blank of a third alternative blank 700 of sheet material for forming an alternate embodiment of the container described herein. FIG. 8 is a perspective schematic illustration of a container 800 formed from blank 700 shown in FIG. 7. Unless otherwise described, blank 700 includes components that are similar to the components described above with reference to blank 10 (shown in FIG. 1) and blank 300 (shown in FIG. 3) and blank 500 (shown in FIG. 5), and container 800 includes components that are similar to the components described above with reference to container 200 (shown in FIG. 2) and container 400 (shown in FIG. 4) container 600 (shown in FIG. 6). As such, components shown in FIGS. 1-4 and 5 and 6 are labeled with similar reference numbers in FIGS. 7 and 8.

Blank 700 includes first top panel 20, first side panel 22, bottom panel 24, second side panel 26', and second top panel 28 coupled together along fold lines 30, 32, 34, and 36, respectively. Blank 700 also includes front end panel 40 and rear end panel 50 coupled to bottom panel 24 along fold lines 71 and 73 respectively. First side panel 22 is similar to first side panel 22 of FIG. 1, and second side panel 26' is similar to second side panel 26' of FIG. 3. Accordingly, the cutouts next to second side panel 26' are larger than the cutouts next to first side panel 22. Blank 700 includes minor panels 112 that are similar in width to minor panels 112 of FIG. 3 so that minor panels 112 can attach to side panels 22 or 26', and, in the case of second reinforcing assembly 42 and fourth reinforcing assembly 52, attach to second overlap panels 118 in an overlapping relationship.

Moreover, blank 700 includes reinforcing assemblies 38, 42, 48 and 52. In the third alternative embodiment, blank 700 is configured such that each inner assembly 104 of respective reinforcing assemblies 38, 42, 48 and 52 is separated from its respective outer assembly 106. Blank 700 includes free edge 702 of minor panel 112 of inner assembly 104 and includes free edge 704 of second overlap panel 118 of outer assembly 106. FIG. 8 illustrates container 800 with miter panel 116 and second overlap panel 118 removed to illustrate corner panel 110 and minor panel 112 of inner assembly 104 and respective free edges 702 and 704.

Figure 9:
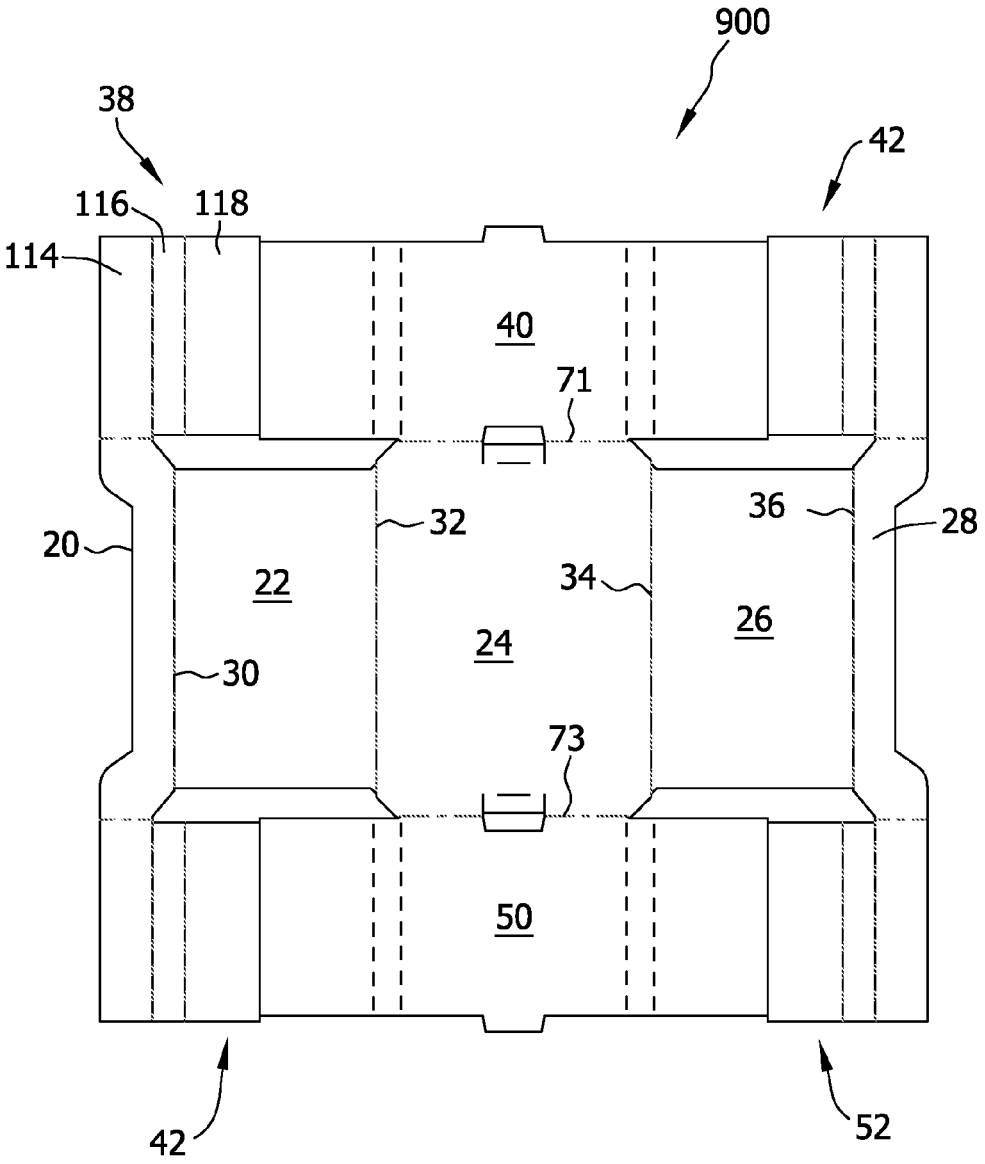
FIG. 9 is a top plan schematic illustration of a blank of sheet material of a fourth alternate embodiment of the present invention.
Figure 10:
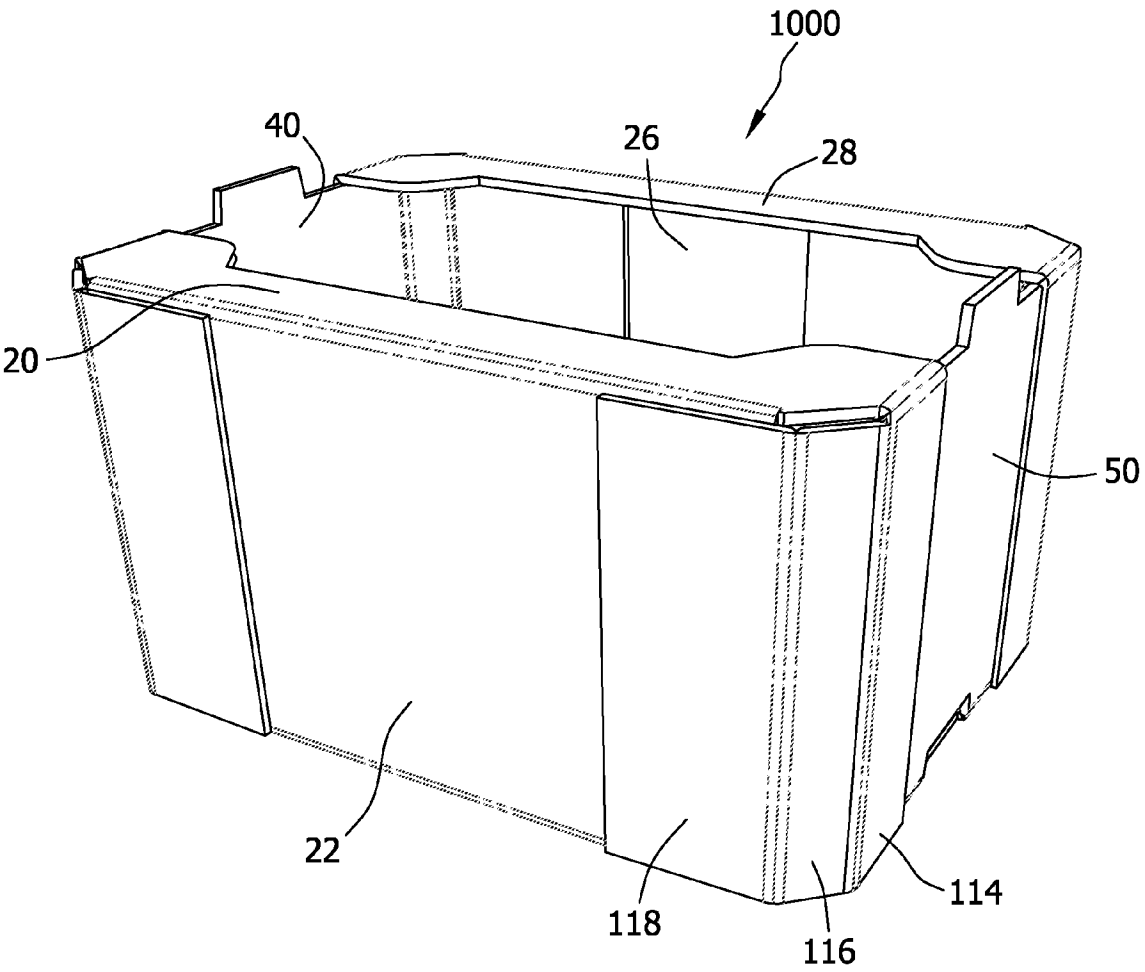
FIG. 10 is a perspective schematic illustration of a container formed from the blank shown in FIG. 9.

FIG. 9 is a top plan view of a blank of a fourth alternative blank 900 of sheet material for forming an alternate embodiment of the container described herein. FIG. 10 is a perspective schematic illustration of a container 1000 formed from the blank 900 shown in FIG. 9. Unless otherwise described, blank 900 includes components that are similar to the components described above with reference to blank 10 (shown in FIG. 1) and blank 300 (shown in FIG. 3), and container 1000 includes components that are similar to the components described above with reference to container 200 (shown in FIG. 2) and container 400 (shown in FIG. 4). As such, components shown in FIGS. 1-4 are labeled with similar reference numbers in FIGS. 9 and 10.

Blank 900 includes first top panel 20, first side panel 22, bottom panel 24, second side panel 26, and second top panel 28 coupled together along fold lines 30, 32, 34, and 36, respectively. Blank 900 also includes front end panel 40 and rear end panel 50 coupled to bottom panel 24 along fold lines 71 and 73 respectively. Moreover, blank 900 includes reinforcing assemblies 38, 42, 48 and 52. In the fourth alternative embodiment, first side panel 22 and second side panel 26 have longer depths/lengths than front end panel 40 and rear end panel 50 as compared to blank 10 of FIGS. 1 and 2. Accordingly, first top panel 20 and second top panel 28 are longer as compared to blank 10 of FIGS. 1 and 2.

Figure 11:
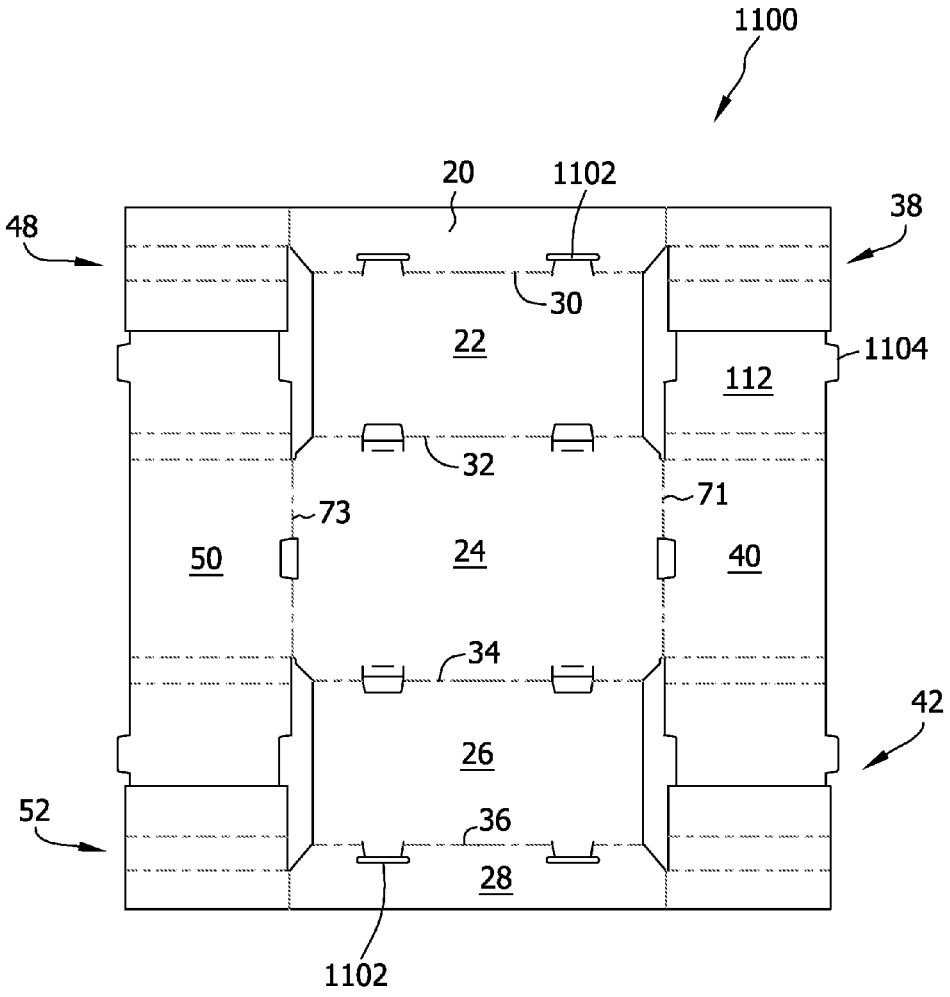
FIG. 11 is a top plan schematic illustration of a blank of sheet material of a fifth alternate embodiment of the present invention.
Figure 12:
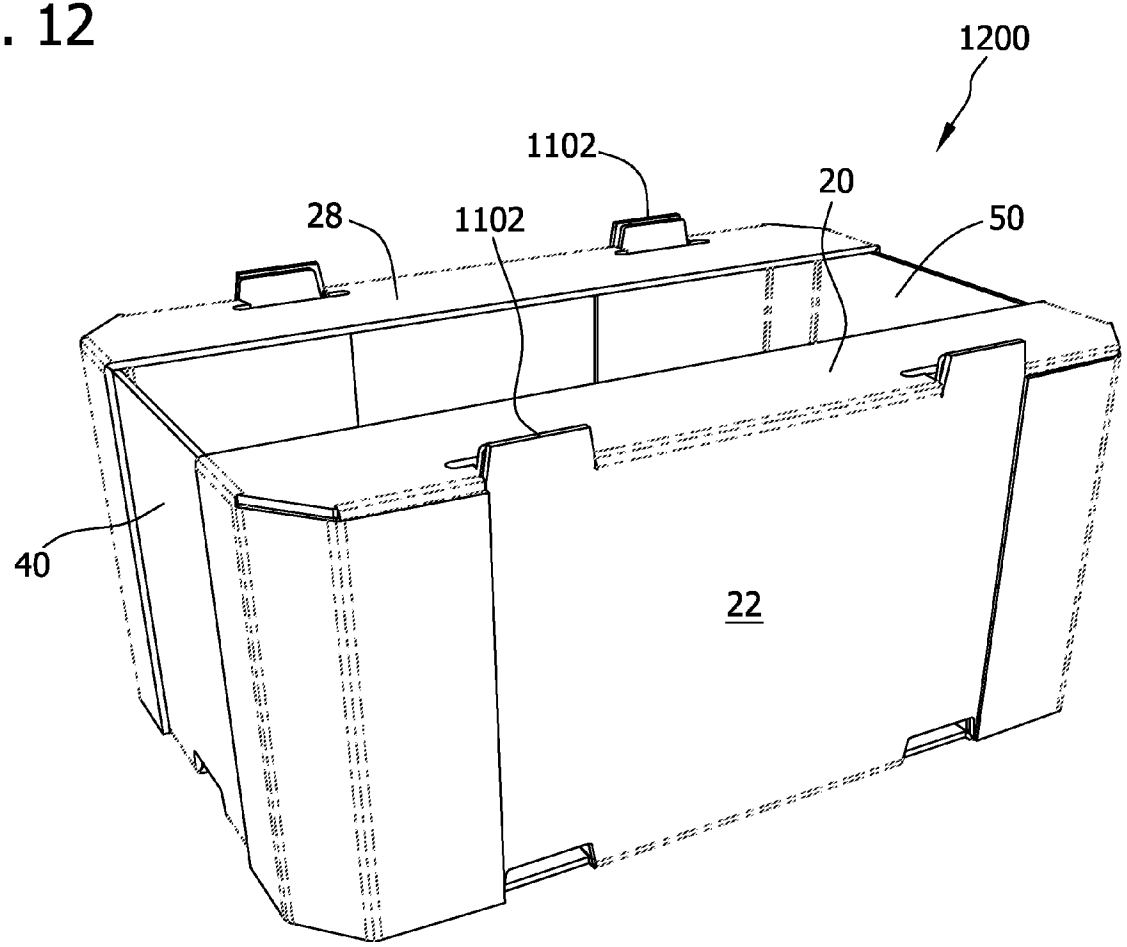
FIG. 12 is a perspective schematic illustration of a container formed from the blank shown in FIG. 11.

FIG. 11 is a top plan view of a blank of a fifth alternative blank 1100 of sheet material for forming an alternate embodiment of the container described herein. FIG. 12 is a perspective schematic illustration of a container 1200 formed from the blank 1100 shown in FIG. 11. Unless otherwise described, blank 1100 includes components that are similar to the components described above with reference to blank 10 (shown in FIG. 1) and blank 300 (shown in FIG. 3) and blank 900 (shown in FIG. 9), and container 1200 includes components that are similar to the components described above with reference to container 200 (shown in FIG. 2) and container 400 (shown in FIG. 4) and container 1000 (shown in FIG. 10). As such, components shown in FIGS. 1-4 and 9 and 10 are labeled with similar reference numbers in FIGS. 11 and 12.

Blank 1100 includes first top panel 20, first side panel 22, bottom panel 24, second side panel 26, and second top panel 28 coupled together along fold lines 30, 32, 34, and 36, respectively. Blank 1100 also includes front end panel 40 and rear end panel 50 coupled to bottom panel 24 along fold lines 71 and 73 respectively. Moreover, blank 1100 includes reinforcing assemblies 38, 42, 48 and 52. In the fifth alternative embodiment, first side panel 22 and second side panel 26 include stacking tabs 1102, and minor panels 112 include stacking tabs 1104 such that, when container 1200 is formed, each stacking tab 1102 is positioned adjacent a corresponding stacking tab 1104 to form a double layered set of stacking tabs.

Figure 13:
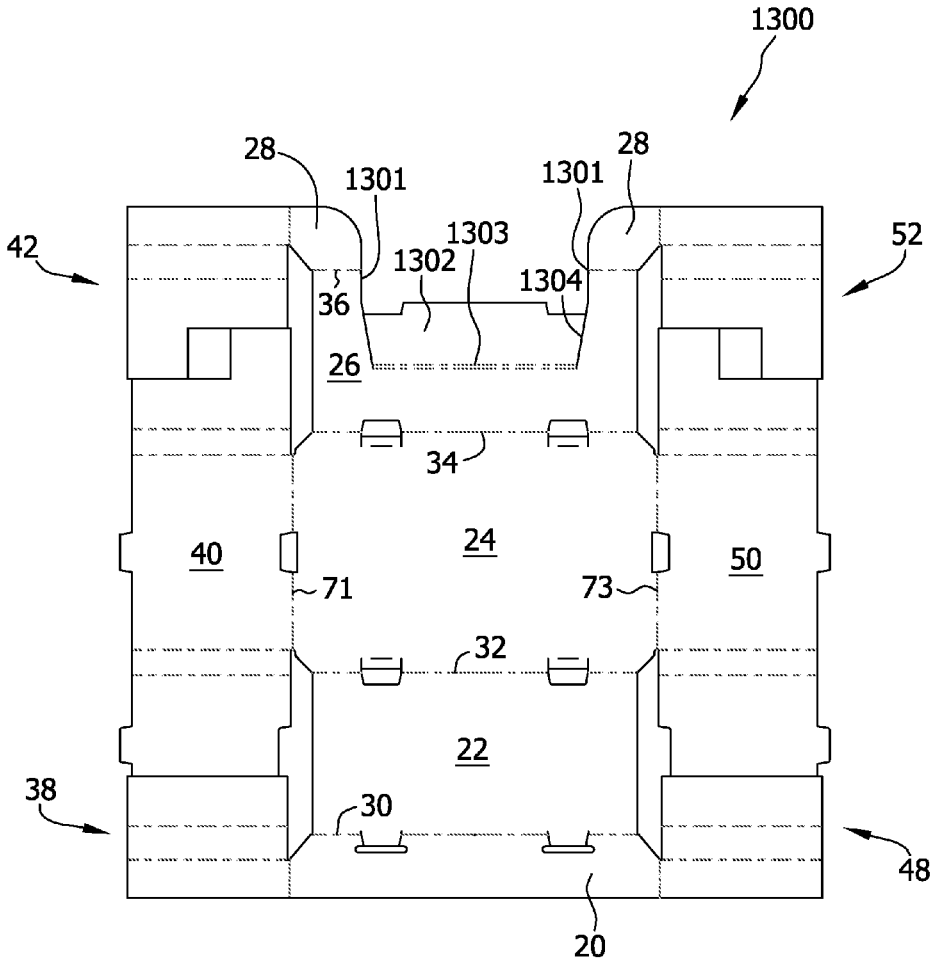
FIG. 13 is a top plan schematic illustration of a blank of sheet material of a sixth alternate embodiment of the present invention.
Figure 14:
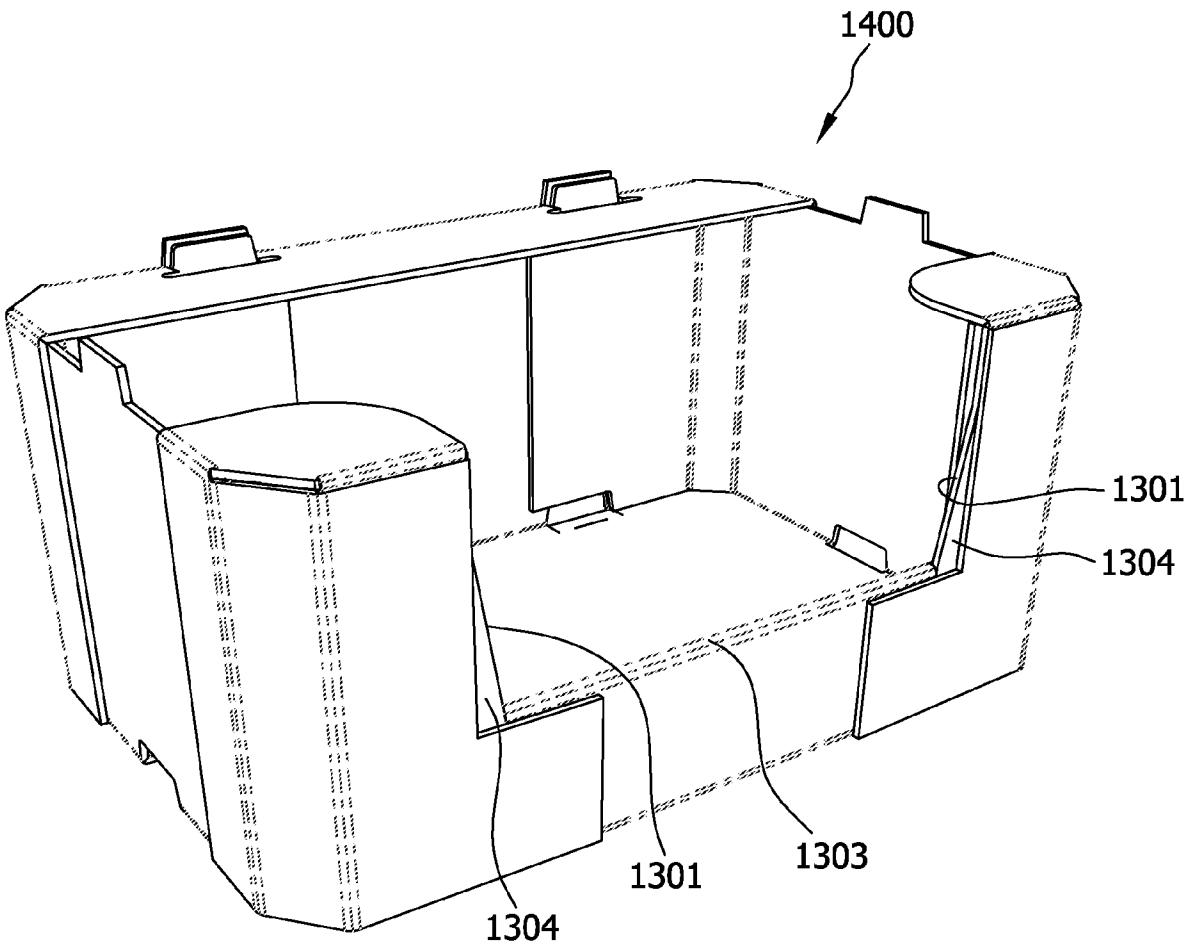
FIG. 14 is a perspective schematic illustration of a container formed from the blank shown in FIG. 13.

FIG. 13 is a top plan view of a blank of a sixth alternative blank 1300 of sheet material for forming an alternate embodiment of the container described herein. FIG. 14 is a perspective schematic illustration of a container 1400 formed from blank 1300 shown in FIG. 13. Unless otherwise described, blank 1300 includes components that are similar to the components described above with reference to blank 10 (shown in FIG. 1) and blank 300 (shown in FIG. 3) and blank 1100 (shown in FIG. 11), and container 1400 includes components that are similar to the components described above with reference to container 200 (shown in FIG. 2) and container 400 (shown in FIG. 4) and container 1200 (shown in FIG. 12). As such, components shown in FIGS. 1-4 and 11 and 12 are labeled with similar reference numbers in FIGS. 13 and 14.

Blank 1300 includes first top panel 20, first side panel 22, bottom panel 24, second side panel 26, and second top panel 28 coupled together along fold lines 30, 32, 34, and 36, respectively. Blank 1300 also includes front end panel 40 and rear end panel 50 coupled to bottom panel 24 along fold lines 71 and 73 respectively. Moreover, blank 1300 include reinforcing assemblies 38, 42, 48 and 52. In the sixth alternative embodiment, second side panel 26 includes angled edges 1301 to define a U-shaped panel 1302. Panel 1302 is folded inward along fold line 1303 toward interior surface 12 of second side panel 26 to expose product (not shown) that is present within container 1400. Second side panel 26 includes a retaining tab 1304 to facilitate preventing product from falling out of container 1400.

Figure 15:
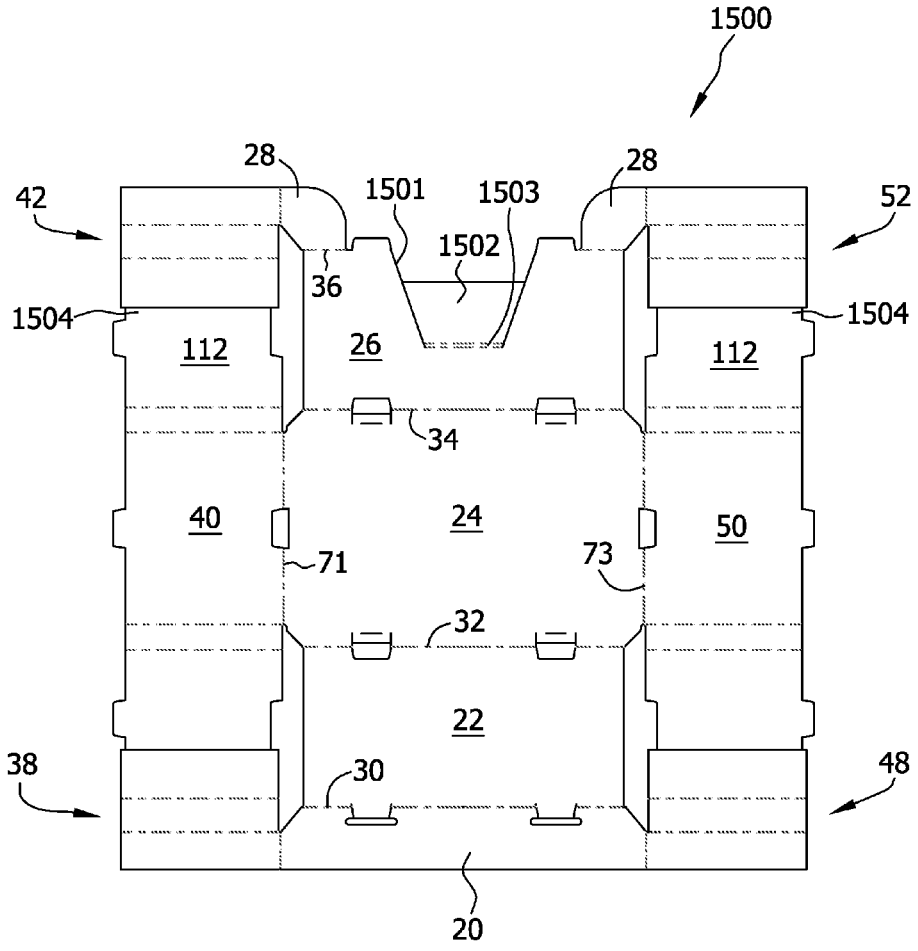
FIG. 15 is a top plan schematic illustration of a blank of sheet material of a seventh alternate embodiment of the present invention.
Figure 16:
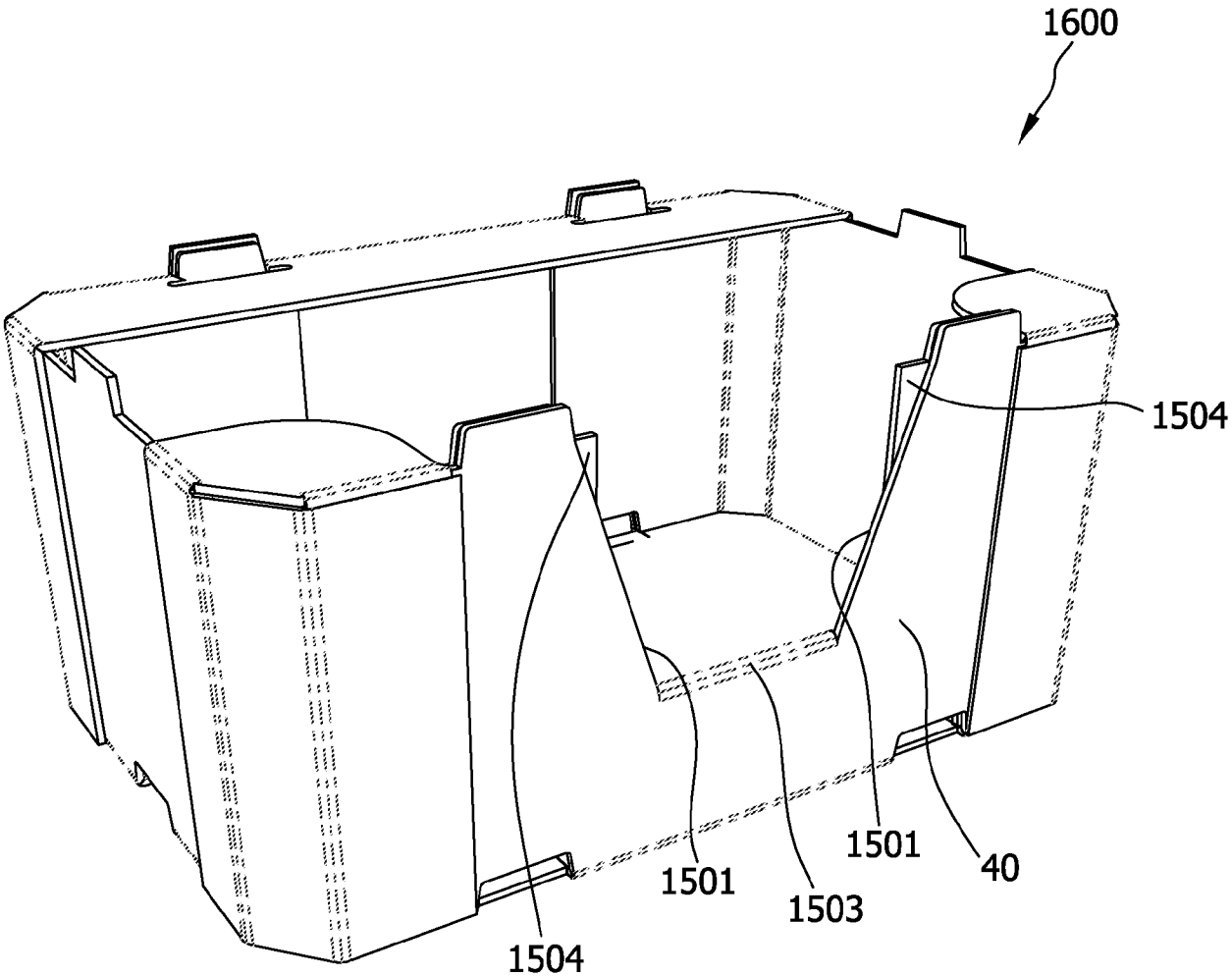
FIG. 16 is a perspective schematic illustration of a container formed from the blank shown in FIG. 15.

FIG. 15 is a top plan view of a blank of a seventh alternative blank 1500 of sheet material for forming an alternate embodiment of the container described herein. FIG. 16 is a perspective schematic illustration of a container 1600 formed from the blank 1500 shown in FIG. 15. Unless otherwise described, blank 1500 includes components that are similar to the components described above with reference to blank 10 (shown in FIG. 1) and blank 300 (shown in FIG. 3) and blank 1300 (shown in FIG. 13), and container 1600 includes components that are similar to the components described above with reference to container 200 (shown in FIG. 2) and container 400 (shown in FIG. 4) and container 1400 (shown in FIG. 14). As such, components shown in FIGS. 1-4 and 13 and 14 are labeled with similar reference numbers in FIGS. 15 and 16.

Blank 1500 includes first top panel 20, first side panel 22, bottom panel 24, second side panel 26, and second top panel 28 coupled together along fold lines 30, 32, 34, and 36, respectively. Blank 1500 also includes front end panel 40 and rear end panel 50 coupled to bottom panel 24 along fold lines 71 and 73 respectively. Moreover, blank 1500 include reinforcing assemblies 38, 42, 48 and 52. In the seventh alternative embodiment, second side panel 26 includes angled edges 1501 to define a substantially V-shaped panel 1502. V-shaped panel 1502 is folded inward along fold line 1503 toward inner surface 12 of second side panel 26 to expose product (not shown) that is present within container 1600. Minor panel 112 includes a retaining tab 1504 to facilitate preventing product from falling out of container 1600.

Figure 17:
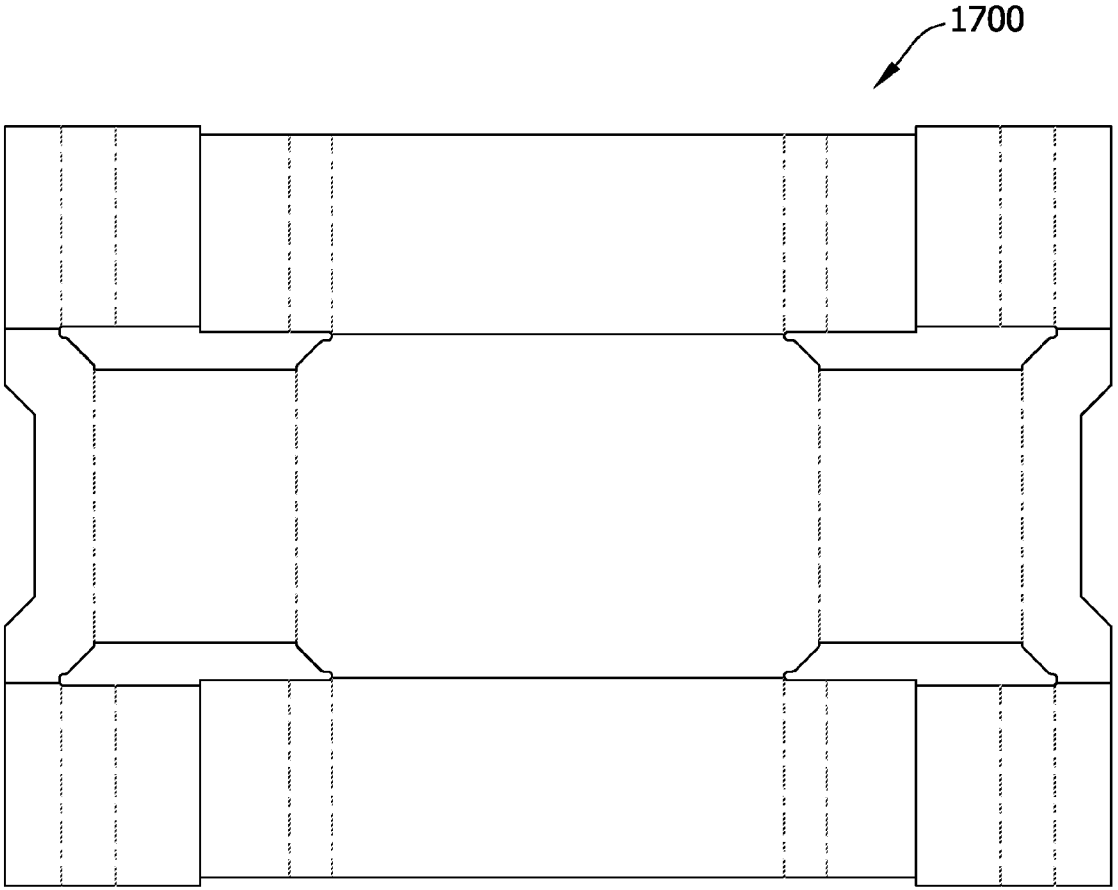
FIG. 17 is a top plan schematic illustration of a blank of sheet material of an eighth alternate embodiment of the present invention.
Figure 18:
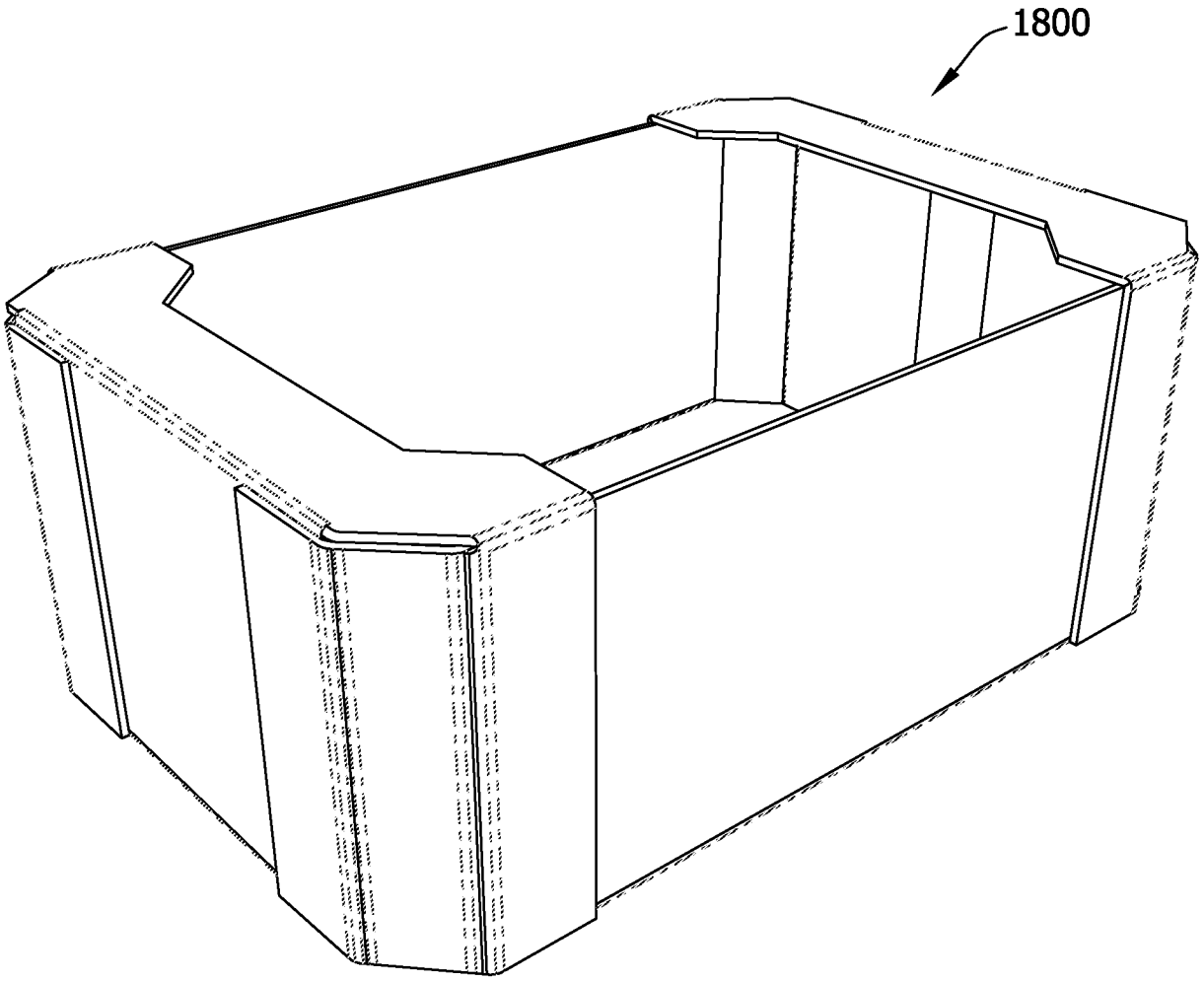
FIG. 18 is a perspective schematic illustration of a container formed from the blank shown in FIG. 17.

FIG. 17 is a top plan view of a blank of an eighth alternative blank 1700 of sheet material for forming an alternate embodiment of the container described herein. FIG. 18 is a perspective schematic illustration of a container 1800 formed from the blank 1700 shown in FIG. 17. Blank 1700 includes components that are similar to the components described above with reference to blank 10 (shown in FIG. 1) and container 1800 includes components that are similar to the components described above with reference to container 200 (shown in FIG. 2).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a reinforced container, the blank comprising:

a bottom panel comprising opposing end edges, opposing side edges, and at least one first miter edge connecting one of the end edges to an adjacent side edge of the opposing side edges;

a pair of opposing end panels coupled to the bottom panel;

a pair of opposing side panels coupled to the bottom panel;

a pair of opposing top panels coupled to the pair of opposing side panels; and a reinforcing panel assembly for reinforcing a corner of the container, the reinforcing panel assembly comprising an inner reinforcing panel assembly and an outer reinforcing panel assembly, the outer reinforcing panel assembly comprising a first overlap panel, a miter panel, and a second overlap panel, wherein the outer reinforcing panel assembly is coupled to one of the top panels.

2. The blank of claim 1, wherein the pair of opposing top panels each comprise a pair of second mitered edges.

3. The blank of claim 1, wherein the pair of opposing top panels each comprise a pair of angled edges and a pair of apexes joined by a free edge.

4. The blank of claim 1, wherein the first overlap panel is coupled to the one of the top panels and the miter panel is coupled between the first overlap panel and the second overlap panel.

5. The blank of claim 1, wherein the inner reinforcing panel assembly is coupled to one of the end panels.

6. The blank of claim 1, wherein the inner reinforcing panel assembly comprises a corner panel and a minor panel.

7. The blank of claim 6, wherein the corner panel is coupled to one of the end panels, and the first overlap panel is coupled to the one of the top panels.

8. The blank of claim 7, wherein the second overlap panel and the minor panel are adjacent.

9. A reinforced container formed from a blank of sheet material, the container comprising:

a bottom wall comprising at least one first miter edge connecting adjacent edges of the bottom wall;

a pair of opposing end walls coupled to the bottom wall;

a pair of opposing side walls coupled to the bottom wall;

a pair of opposing top walls coupled to the pair of opposing side walls; and a reinforcing corner assembly for reinforcing a corner of the container, the reinforcing corner assembly comprising an inner reinforcing panel assembly and an outer reinforcing panel assembly, the outer reinforcing panel assembly comprising a first overlap panel, a miter panel, and a second overlap panel, wherein the outer reinforcing panel assembly is coupled to one of the top walls, one of the end walls, and at least one of the inner reinforcing panel assembly and one of the side walls.

10. The container of claim 9, wherein the pair of opposing top walls each comprise a pair of second mitered edges substantially aligned with the at least one first miter edge.

11. The container of claim 9, wherein the second overlap panel is substantially flush with one of the side walls.

12. The container of claim 9, wherein the inner reinforcing panel assembly is coupled to one of the end walls and one of the side walls.

13. The container of claim 9, wherein the inner reinforcing panel assembly comprises a corner panel and a minor panel.

14. The container of claim 13, wherein the minor panel is coupled to one of the side walls, the first overlap panel is coupled to one of the end walls, the miter panel is coupled to the corner panel, and the second overlap panel is coupled to the minor panel and/or one of the side walls.

15. A method of forming a reinforcing container from a blank of sheet material, the blank including a bottom panel comprising at least one miter edge connecting adjacent edges of the bottom panel, a pair of opposing end panels coupled to the bottom panel, a pair of opposing side panels coupled to the bottom panel, a pair of opposing top panels coupled to the pair of opposing side panels, and a reinforcing panel assembly for reinforcing a corner of the container, the reinforcing panel assembly comprising an inner reinforcing panel assembly and an outer reinforcing panel assembly comprising a first overlap panel, a miter panel, and a second overlap panel, wherein the outer reinforcing panel assembly is coupled to one of the top panels, the method comprising:

rotating the pair of end panels toward the bottom panel to form a pair of opposing end walls;

rotating the pair of side panels toward the bottom panel to form a pair of opposing side walls;

rotating the top panels toward the side walls and the bottom panel to form a pair of opposing top walls; and rotating the reinforcing panel assembly to form a reinforcing corner assembly.

16. The method of claim 15, further comprising coupling the reinforcing corner assembly to one of the end walls and one of the side walls.

17. The method of claim 15, wherein said rotating the reinforcing assembly comprises rotating the inner reinforcing panel assembly, coupling the inner reinforcing panel assembly to one of the side walls, rotating the outer reinforcing panel assembly, and coupling the outer reinforcing panel assembly to at least one of the inner reinforcing panel assembly and one of the side walls to form the reinforcing corner assembly.

18. The method of claim 17, wherein the inner reinforcing panel assembly includes a corner panel and a minor panel, and wherein said coupling the inner reinforcing panel assembly comprises coupling the minor panel to one of the side walls.

19. The method of claim 17, wherein said coupling the outer reinforcing panel assembly comprises coupling the first overlap panel to one of the end walls and coupling the second overlap panel to at least one of the minor panel and one of the side panels.

20. The method of claim 19, wherein said coupling the outer reinforcing panel assembly further comprises coupling the miter panel to the corner panel.

* * * * *